US005759980A

United States Patent [19]

Russo et al.

[11] Patent Number: 5,759,980

[45] Date of Patent: Jun. 2, 1998

[54] CAR WASH

[75] Inventors: Brian A. Russo, Cleveland; Ronald L. Fausnight, N. Canton; David A. Lupyan, Chagrin Falls, all of Ohio

[73] Assignee: Blue Coral, Inc., Cleveland, Ohio

[21] Appl. No.: 810,398

[22] Filed: Mar. 4, 1997

[51] Int. Cl.[6] ..... C11D 3/37; C11D 1/82

[52] U.S. Cl. ..... 510/241; 510/434; 510/466; 510/475; 510/476

[58] Field of Search ..... 510/241, 438, 510/466, 475, 476, 506

[56] References Cited

U.S. PATENT DOCUMENTS

| | | | |
|---|---|---|---|
| 2,703,288 | 3/1955 | Worson | 99/222 |
| 3,299,112 | 1/1967 | Bailey . | |
| 3,306,869 | 2/1967 | Lahr | 260/24 |
| 3,562,786 | 2/1971 | Bailey et al. | 252/137 |
| 4,005,028 | 1/1977 | Heckert et al. . | |
| 4,284,668 | 8/1981 | Nixon . | |
| 4,287,080 | 9/1981 | Siklosi . | |
| 4,311,695 | 1/1982 | Starch . | |
| 4,497,919 | 2/1985 | Varga | 524/10 |
| 4,782,095 | 11/1988 | Gum . | |
| 4,927,667 | 5/1990 | Shih et al. | 427/154 |
| 4,936,643 | 6/1990 | Beiser . | |
| 4,936,914 | 6/1990 | Hurley et al. | 106/3 |
| 4,952,248 | 8/1990 | Aberg . | |
| 5,104,643 | 4/1992 | Grollier et al. | 424/47 |
| 5,227,067 | 7/1993 | Runyon . | |
| 5,330,787 | 7/1994 | Berlin et al. . | |
| 5,494,611 | 2/1996 | Howe . | |
| 5,534,198 | 7/1996 | Masters et al. | 510/182 |

FOREIGN PATENT DOCUMENTS

| | | | |
|---|---|---|---|
| 96/34933 | 11/1996 | WIPO | C11D 1/14 |
| WO 96/34933 | 11/1996 | WIPO . | |

OTHER PUBLICATIONS

Silwet Surfactants, OSI Specialties, Product Literature, 1994.

Fluorad, Fluorochemical Surfactants, 3M Product Literature, 1993.

Zonyl Fluorosurfacants, DuPont Specialty Chemicals Product Literature, Aug. 1993.

Ganex X Polymers, Alkylated Vinylpyrrolidone Polymers, product specification sheets.

*Primary Examiner*—Ardith Hertzog
*Assistant Examiner*—Greg Webb
*Attorney, Agent, or Firm*—Calfee, Halter & Griswold LLP

[57] ABSTRACT

A novel car wash composition substantially eliminates water-spotting. This novel car wash composition is comprised of: a surfactant package which is comprised of a first surfactant selected from the group consisting essentially of an anionic surfactant, a nonionic surfactant and mixtures thereof; and a second surfactant selected from the group consisting essentially of fluorosurfactant, a silicone surfactant, and mixtures thereof; and a substantive polymer that renders the surface to be cleaned more hydrophilic.

28 Claims, No Drawings

CAR WASH

BACKGROUND OF THE INVENTION

The present invention relates to an improved car wash composition. Many car wash products are available commercially. Typically, these products include a conventional soap or detergent, e.g. an anionic surfactant. Cationic and nonionic surfactants can also be used, as can mixtures of surfactants. Such compositions may also contain conventional detergent builders for neutralizing hard minerals dissolved in the water.

After washing with a conventional car wash, the washed surface is typically rinsed with water to remove the car wash and the dirt entrained therein. In addition, the washed and rinsed surface is typically wiped with a cloth or chamois to physically remove rinse water remaining on the washed surface.

Most waters include various dissolved minerals such as $Ca^{++}$ and $Mg^{++}$. Since a modern automobile surface, particularly one which has been waxed or polished, exhibits relatively low surface energy, rinse water left on the washed surface tends to form itself into beads. If these water beads are left to dry by simple evaporation, the minerals in the water deposit on the washed surface in the form of noticeable spots. Accordingly, it is customary to wipe the washed surface with a cloth or chamois to physically remove these rinse water beads to prevent water-spotting from occurring.

Wiping washed and rinsed surfaces adds time and effort to the overall car-washing process. Accordingly, it would be desirable to provide a new car wash which, not only effectively cleans the surfaces to be washed, but which also prevents water-spotting from occurring, even if the rinsed surface is not physically wiped to remove residual water.

SUMMARY OF THE INVENTION

In accordance with the present invention, a novel car wash has been developed which is capable of effectively preventing rinse water spotting, even though the rinse water is left on the washed surface to dry by normal evaporation. This novel car wash composition is comprised of: a surfactant package which is comprised of a first surfactant selected from the group consisting essentially of an anionic surfactant, a nonionic surfactant and mixtures thereof; and a second surfactant selected from the group consisting essentially of fluorosurfactant, a silicone surfactant and mixtures thereof; and a substantive polymer that renders the surface to be cleaned more hydrophilic.

In accordance with the present invention, it has been found that such a composition, when used in combination with water to wash an automobile surface, effectively cleans the surface in the same manner as conventional car washes. In addition, it has been further found that waters used to rinse surfaces cleaned with this car wash leave essentially no noticeable spots when the surfaces are allowed to dry by simple evaporation. Accordingly, it is possible in accordance with the present invention to produce washed surfaces essentially free of water spots while at the same time eliminating the hand drying step normally done in the past.

DETAILED DESCRIPTION OF THE INVENTION

The novel car wash of the present invention is composed of a first surfactant which may be either an anionic detergent surfactant or a nonionic surfactant, or a mixture thereof, a second surfactant which is a selected from the group consisting essentially of a fluorosurfactant, silicone surfactant, and mixtures thereof; and a substantive polymer that renders the surface to be cleaned more hydrophilic. Preferably, the novel car wash of the present invention contains both anionic surfactant and nonionic surfactant.

Anionic Surfactants

The anionic surfactant useful in the present invention can be any anionic surfactant capable of acting as a detergent or soap. This class of surfactants includes ordinary alkali metal soaps such as the sodium, potassium, ammonium and alkanolammonium salts of higher fatty acids containing from about 8 to about 24 carbon atoms, preferably from about 10 to about 20 carbon atoms. Suitable fatty acids can be obtained from natural sources such as, for instance, plant or animal esters (e.g., palm oil, coconut oil, babassu oil, soybean oil, castor oil, tallow, tall oil, whale and fish oils, grease, lard, and mixtures thereof). The fatty acids also can be synthetically prepared, for example, by the oxidation of petroleum, or by the Fischer-Tropsch process. Resin acids are suitable such as rosin and those resin acids in tall oil. Napthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap.

Useful anionic surfactants also include watersoluble salts, particularly the alkali metal salts, of organic sulfuric reaction products having an alkyl group containing from about 8 to about 22 carbon atoms and a sulfonic acid or sulfuric acid ester radical. (Included in the term "alkyl" is the alkyl portion of higher acyl groups.) Examples of this group of surfactants are: the water-soluble sodium, potassium, magnesium or ammonium alkyl sulfates, especially those obtained by sulfating the higher alcohols, that is those alcohols having from about 8 to 18 carbon atoms, produced by reducing the glycerides of tallow or coconut oil; sodium or potassium alkyl benzene sulfates, in which the alkyl group contains from about 8 to 18 carbon atoms in straight chain or branched chain configuration, e.g., those of the type described in U.S. Pat. Nos. 2,220,099 and 2,477,383. Especially valuable are linear straight chain alkyl benzene sulfonates, in which the average of the alkyl groups is about 11–12 carbon atoms, commonly abbreviated as "LAS"; alpha oelifn sulphonates, in which the average of the alkyl groups is about 10–16 carbon atoms, preferably about 12–14 carbon atoms, commonly abbreviated "AOS"; sodium alkyl glyceryl ether sulfonates, especially those ethers of higher alcohols derived from tallow and coconut oil; sodium coconut oil fatty acid monoglyceride sulfonates and sulfates.

Another group of useful anionic surfactants are the alkali metal paraffin sulfonates containing from about 8 to 22 carbon atoms in the paraffin chain. These are well-known commercially available surfactants which are prepared, for example, by the reaction of olefins with sodium bisulfite. Examples are sodium-1-decane sulfonate, sodium-2-tridecane sulfonate and potassium-2-octadecane sulfonate. A related group of surfactants are those having the following formula:

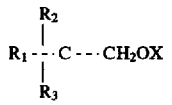

wherein:

$R_1$, $R_2$ and $R_3$ are the same or different alkyl groups having from 1 to 18 carbon atoms, the sum of the carbon atoms of $R_1$, $R_2$ and $R_3$ being 10 to 20 carbon atoms;

X is $—SO_3M$, $—CH_2COOM$, $—CH_2CH_2COOM$, $—(CH_2CH_2O)_nSO_3M$ or $—(CH_2CH_2O)_nCOOM$;

n is an integer from 1 to 40; and

M is an alkali metal.

M is, for example, sodium or potassium. Such compounds are more fully described in U.S. Pat. No. 3,929,661, Nakagawe et al., issued Dec. 30, 1975, the disclosure of which is incorporated herein by reference.

Other synthetic anionic surfactants useful herein are alkyl ether sulfates. These materials have the formula:

$$[RO(C_2H_4O)_xSO_3]_yM$$

wherein:

R is alkyl or alkenyl group of about 8 to about 22 carbon atoms;

x is an integer from 1 to 30; and

M is a water-soluble cation, as defined hereinbefore, having a valency of y. R is prefereably an alkyl group having about 10 to 20 carbon atoms, more preferably about 12 to 18 carbon atoms. The alkyl ether sulfates useful in the present invention are ion products of ethylene oxide and monohydric alcohols having about 10 to about 20, preferably 12 to 18, carbon atoms. The alcohols can be derived from fats, e.g., coconut oil or tallow, or can be synthetic. Lauryl alcohol and straight chain alcohols derived from tallow are preferred. Such alcohols are reacted with 1 to 30, and especially 3 to 6, molar proportions of ethylene oxide and the resulting mixture of molecular species, having, for example, an average of 3 to 6 moles of ethylene oxide per mole of alcohol, is sulfated and neutralized.

Suitable alkyl ether sulfates of the present invention include for example: sodium coconut alkyl ethylene glycol ether sulfate; lithium tallow alkyl triethylene glycol ether sulfate, sodium tallow alkyl hexaoxyethylene sulfate; and sodium tallow alkyl trioxyethylene sulfate. The alkyl ether sulfates are known compounds and are described in U.S. Pat. No. 3,332,876 to Walker, the disclosure of which is incorporated herein by reference.

Other suitable synthetic anionic surfactants include the alkali metal salts of alkyl phenol ethylene oxide ether sulfate with about four units of ethylene oxide per molecule and in which the alkyl radicals contain about 9 carbon atoms; the reaction product of fatty acids esterified with isothionic acid and neutralized with sodium hydroxide where, for example, the fatty acids are derived from coconut oil; sodium or potassium salts of fatty acid amides of a methyl taurine in which the fatty acids, for example, are derived from coconut oil; and others known in the art.

Preferred anionic surfactants in accordance with the present invention include $C_{12}$ to $C_{18}$ alkyl benzene sulfonates, $C_{12}$ to $C_{18}$ alkyl sulfates, $C_{12}$ to $C_{18}$ ethoxylated alkyl sulfates having from 1 to 10 ethoxy moieties, and sodium paraffin sulfonates wherein the alkyl portion contains from 8 to 16 carbon atoms. For reasons of cleaning efficacy, economics and environmental compatibility, sodium or potassium linear alkyl benzene sulfonates having from 11 to 12 carbon atoms ($C_{11.8avg}$) in the alkyl portion are most particularly preferred. Sodium and potassium dodecylbenzenesulfonate are especially preferred.

Nonionic Surfactants

The nonionic surfactants useful in accordance with the present invention comprise any of the nonionic compounds known to exhibit surface active properties. Such compounds can be divided into three basic types: alkylene oxide condensates; amides; and semi polar nonionic surfactants.

The alkylene oxide condensates are broadly defined as compounds produced by the condensation of a hydrophillic alkylene oxide groups with an aliphatic or aromatic organic hydrophobic compound. The length of the hydrophilic polyoxyalkylene radical which is condensed with such hydrophobic group can be readily adjusted to provide a water-soluble compound having the desired degree of hydrophilic and hydrophobic properties.

Examples of suitable alkaline oxide condensates include the condensation products of aliphatic alcohols with ethylene oxide. The alkyl chain of the aliphatic alcohol is either straight or branched and contains from about 8 to 22 carbon atoms. The chain of ethylene oxide has from about 2 to 30 ethylene oxide moieties per molecule of surfactant. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains having from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by the Procter & Gamble Company.

Other suitable alkaline oxide condensates are the polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the Rohne-Poulenc Corporation; and Triton X-45, X-100 and X-102, all marketed by Union Carbide Corporation.

Still other suitable alkaline oxide condensates are the condensation products of ethylene oxide with a hydrophobic base formed by the condensation of propylene oxide with propylene glycol. The hydrophobic portion of these compounds has a molecular weight of from about 1,500 to 1,800. The addition of polyoxyethylene moieties to this hydrophobic portion tends to increase the water solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the BASF Corporation.

Still further suitable alkaline oxide condensates are the condensation products of ethylene oxide with the product resulting from the reaction of propylene oxide and ethylene diamine. The hydrophobic base of these products is the reaction product of ethylene diamine and excess propylene oxide, said base having a molecular weight of from about 2,500 to about 3,000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the BASF Corporation.

The amide type of nonionic surface active agents includes the ammonia, monoethanol and diethanol amides of fatty acids having an acyl moiety of from about 7 to about 18 carbon atoms. Such acyl moieties are typically derived from naturally occurring glycerides, such as coconut oil, palm oil, soybean oil and tallow, but can be derived synthetically, e.g., by the oxidation of petroleum, or by the Fischer Tropsch process.

The amide surfactants useful herein may be selected from those aliphatic amides of the general formula:

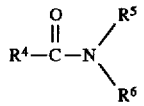

wherein:

$R^4$ is hydrogen, alkyl, or alkylol; and $R^5$ and $R^6$ are each hydrogen, $C_2$ to $C_4$ alkyl, $C_2$ to $C_4$ alkylol or $C_2$ to $C_4$ alkylenes joined through an oxygen atom; and the total number of carbon atoms in $R^4$, $R^5$ and $R^6$ is from about 9 to about 25.

A further description and detailed examples of these amide nonionic surfactants are contained in U.S. Pat. No. 4,070,309, issued to Jacobsen on Jan. 24, 1978, the disclosure of which is incorporated herein by reference. A suitable alkanolamide surfactant is commercially available as Witcamide cda, from Witco.

The semi-polar type of nonionic surface active agents include the amine oxides, phosphine oxides and sulfoxides.

The amine oxides are tertiary amine oxides corresponding to the general formula:

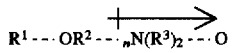

in which:

$R^1$ is an alkyl radical of from about 8 to about 18 carbon atoms;

$R^2$ is an alkylene or a hydroxy alkylene group containing 2 to 3 carbon atoms;

n is an integer ranging from 0 to about 20; and each $R^3$ is selected from the group of alkyl groups having 1 to 3 carbon atoms, or hydroxyalkyl groups having 1–3 carbon atoms and mixtures thereof.

The arrow in the formula is a conventional representation of a semi-polar bond. The preferred amine oxide detergents are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldibutylamine oxide, octadecyldibutylamine oxide, bis(2-hydroxyethyl)dodecylamine oxide, bis(2-hydroxyethyl)-3-dodecyloxy-1-hydroxypropylamine oxide, dimethyl-(2-hydroxydodecyl)amine oxide, 3,6,9,-trioctadecyldimethylamine oxide and 3-dodecyloxy-2-hydroxypropyldi-(2-hydroxyethyl)amine oxide.

The semi-polar nonionic detergents also include the water-soluble phosphine oxides, which are useful in the present invention, and have one alkyl or hydroxyalkyl moiety of from 8 to 28, preferably from 8 to 16 carbon atoms, and 2 alkyl moieties selected from the group consisting of alkyl groups and hydroxyalkyl groups containing 1 to 3 carbon atoms. Suitable phosphine oxides include, for example, dimethyldecylphosphine oxide, dimethyltetradecylphosphine oxide, bis(2-hydroxyethyl)dodecylphosphine oxide, and bis(hydroxymethyl)tetradecylphosphine oxide.

Other suitable semi-polar nonionic detergents include, for example, the water-soluble sulfoxide detergents, which contain one alkyl or hydroxyalkyl moiety of 8 to 18 carbon atoms, preferably 12 to 16 carbon atoms and one alkyl moiety selected from the group consisting of alkyl and hydroxyalkyl groups having 1 to 3 carbon atoms. Specific examples of the sulfoxides include dodecylmethyl sulfoxide, 2-hydroxyethyltridecyl sulfoxide, hexadecylmethyl sulfoxide and 3-hydroxyoctadecylethyl sulfoxide.

Preferred nonionic surfactants for use in the present invention are the alkyl oxide condensates of alkylphenols and the alkyl oxide condensates of aliphatic alcohols. The alkyl oxide condensates are preferably polyethylene or polypropylene oxide condensates. The polyethylene oxide condensates of alkyl phenols, especially those having about 10 to 15 mole polymerized ethylene oxide per mole of phenol and further wherein the alkyl group contains 8 to 12 carbon atoms, are especially preferred.

Silicone Surfactants

Silicone surfactants useful in the inventive car wash composition include any organosilane or organosiloxane exhibiting surface active properties. Preferably, the silicone surfactants have a molecular weight of from about 600 to about 10,000, more preferably about 900 to about 6000, most preferably about 3000. Typically, these compounds are composed of condensation products of alkyl-substituted siloxanes, e.g. dimethyl siloxane, copolymerized with condensation products of alkylene oxide, e.g. poly(ethylene oxide). Such compounds are well known in the art. Examples of such compounds are those shown in U.S. Pat. No. 3,299,112, issued to Bailey; U.S. Pat. No. 4,311,695 issued to Starch; and U.S. Pat. No. 4,782,095, issued to Gum, the disclosures of which are incorporated herein by reference.

Also, the siloxane oligomers described in U.S. Pat. No. 4,005,028, issued to Heckert et. al. Jan. 25, 1977, the disclosure of which is incorporated herein by reference, are useful in the present invention.

Preferred silicone surfactants for use in the present invention have a weight average molecular weight of from about 500 to 10,000, preferably from about 1,000 to 5,000, most preferably about 3,000, a viscosity at 25° C. of about 20 to 4000 cSt, preferably 50 to 500 cSt, more preferably 80 to 200 cSt and a surface tension at 25° C. in 0.1% concentration in water of 20 to 33, preferably 22 to 30, N/m. Preferred silicone surfactants for use in the present invention are polysiloxane polyethylene glycol copolymers. A suitable polysiloxane polyethylene glycol copolymer silicone surfactant is sold by Wacker Chemical Company of Munich, Germany, under the designation Silicone Fluid L 066. A preferred silicone surfactant is polyalkylene oxide-modified polydimethylsiloxane block copolymer sold by Osi, under the designation Silwet L 7602, CAS No. 68938-54-5, which has a molecular weight of about 3000, an estimated hydrophile-lipophile balance number of about 5 to 8 (as determined by the method of Griffin OFF. Dig.Fed. paint and Varnish Production Clubs, 28, 446 (1956)), a specific gravity of 1.027, flash point of about 260° C., a pour point of about −15° C., an average weight per gallon of 8.54 pounds at 25° C., and an aqueous surface tension of 26.6 Dynes/cm at 0.1% by weight, aqueous solution. Other suitable silicone surfactants are commercially available from Path Silicones, Phoenix Chemical, and General Electric. For purposes of this invention, silicone surfactants are not considered to include fluorosurfactants.

Fluorosurfactant

The fluorosurfactant has a hydrophilic segment and a hydrophobic segment. The hydrophilic segment comprises an alkyl group having from about 2 to 12 carbons and an ester, sulfonate, or carboxylate moiety. Fluorosurfactants can typically achieve a surface tension as low as about 15 dynes/cm at 0.005% in hydrocarbon solvents. The hydrophobic segment of the fluorosurfactant is fluorinated and typically has the following formula:

$$F(CF_2CF_2)_{3-8}$$

Ammonium perfluoroalky carboxylates and potassium fluoroalky carboxylate are preferred fluorosurfactants. Suitable fluorosurfactants are commercially available from Dupont Specialty Chemicals Division under the trade names "Zonyl" and from 3M Specialty Chemicals Division under the trade names "Fluorad". A particularly suitable fluorosurfactant, FC-129 Fluorad, is aqueous mixture of potassium fluoroalkyl carboxylates and has from about 40 to 44% of fluoroalkyl carboxylates having 8 carbons in the alkyl chain, from about 1 to 5% fluoroalkyl carboxylates having 6 carbons in the alkyl chain, from about 1 to 5% fluoroalkyl carboxylates having 4 carbons in the alkyl chain, from about 1 to 3% fluoroalkyl carboxylates having 7 carbons in the alkyl chain, and from about 0.1 to 1.0% fluroalkyl carboxylates having 5 carbons in the alkyl chain. Another particularly suitable fluorosurfactant, designated "FSO" from Zonyl, has the chemical structure:

$$F\,(CF_2CF_2)_{3-8}CH_2CH_2O(CH_2CH_2O)_yH$$

and surface tension in deionized water of 22 dyn/cm at a concentration of 0.001% at 25° C.

Substantive Polymer

An important part of the inventive car wash composition is the substantive material that improves the hydrophilicity of the surface being washed. This increase in hydrophilicity provides improved appearance when the washed surface is rinsed and then dried. Although not wishing to be bound to any theory, it is believed this effect is due to the fact that rinse water left on the washed surface, particularly painted surfaces, "sheets out" into a thin, wide area layer rather than congealing into thicker, discrete puddles or droplets. Because of this "sheeting" action, rinse water which is drawn off the washed surface by gravity flows off the surface in sheet form rather than in the form of rivulets. Furthermore, water left on the washed surface is spread out in a very thin layer rather than being segregated into discrete, spaced droplets. Accordingly, when this layer dries through evaporation of the water, any minerals therein are also spread out relatively evenly on the washed surface in relatively low concentration rather than being concentrated into specific, discrete locations. The net effect is that water spotting is largely eliminated, even though the rinse water has not been physically removed as in prior practice.

The polymers can serve as substantive polymers in accordance with the present invention contain hydrophilic groups, especially sulfonate and/or carboxylate groups. Other materials that can provide substantivity and hydrophilicity include cationic materials that also contain hydrophilic groups and polymers that contain multiple ether linkages. Cationic polymers include cationic polysaccharides. The typical block copolymer detergent surfactants based on mixtures of polypropylene oxide and ethylene oxide are representative of the polyether materials. The polyether materials are less substantive, however. Also, for the purposes of the invention, organosilane and organosiloxanes exhibiting surface active properties are not regarded as substantive polymers.

The preferred substantive polymers are those formed by polymerization of monomers, at least some of which contain carboxylic functionality. Suitable monomers include, for example, acrylic acid, maleic acid, ethylene, vinyl pyrrollidone, methacrylic acid, and methacryloylethylbetaine. Preferred polymers for substantivity are those having weight average molecular weights above 10,000, preferably more than about 20,000, more preferably more than about 200,000. Polymers having weight average molecular weights of more than about 3,000,000, are extremely difficult to formulate and are less effective in providing anti-spotting benefits than lower molecular weight polymers. Accordingly, the preferred molecular weight ranges, especially for polyacrylates, are from about 10,000 to about 3,000,000, preferably from about 20,000 to about 2,000,000, more preferably from about 100,000 to about 1,000,000, and even more preferably from about 200,000 to about 500,000.

Some polycarboxylate polymers are particularly effective detergent builders; they do not impair filming/streaking and they provide increased cleaning effectiveness on typical, common "hard-to-remove" soils that contain particulate matter.

Some polymers, especially polycarboxylate polymers, thicken aqueous compositions. While this can be desirable, extensive thickening should be avoided in compositions to be used in spray bottles so that excessive trigger pressure can be avoided. Preferably, the viscosity under shear of the inventive car wash compositions of the present invention are less than about 200 cp, preferably less than about 100 cp, more preferably less than about 50 cp. However, when cleaning vertical surfaces, thick car wash compositions may be desirable to inhibit the flow of the composition off the surface.

Other suitable materials useful as substantive polymers include high molecular weight sulfonated polymers such as sulfonated polystyrene. A typical formula is as follows:

$$-[CH(C_6H_4SO_3Na)\,CH_2]-CH(C_6H_5)-CH_2-$$

wherein n is a number to give a molecular weight from about 10,000 to about 1,000,000, preferably from about 200,000 to about 700,000.

Examples of preferred materials for use herein include poly(vinylpyrrolidone/acrylic acid) anionic copolymers, preferably linear random copolymers of vinylpyrrolidone and acrylic acid having from a vinylpyrrolidone/acrylic acid ratio of from 20:80 to 80:20, preferably from 25:75 to 75:25. The most preferred substantive polymer has a weight average molecular weight of about 250,000 as determined by gel permeation chromatography, and a ratio of vinyl pyrrolidone to acrylic acid of about 25:75. Poly(vinylpyrrolidone/acrylic) acid polymers containing 5 to 50, mole %, preferably 15 to 35 mole %, more preferably 20 to 30 mole %, of vinyl pyrrolidone are especially preferred. Suitable vinylpyrrolidone/acrylic acid copolymers are sold under the name "Acrylidone"® by ISP.

Other suitable materials include, for example, a poly (acrylic acid) sold under the name "Accumerl"® by Rohm & Haas. Sulfonated polystyrene polymers sold under the name Versaflex® sold by National Starch and Chemical Company, especially Versaflex 7000.

Alkalinity Source

The inventive car wash compositions should be neutral to slightly basic pH, as an alkaline pH stabilizes the substantive polymer in water, particularly where the substantive polymer contains an acid. A pH of about 7 to about 12 is preferred; a pH from about 10 to about 11.5 is more preferred. For this purpose, it is preferable to include in the inventive car wash compositions an alkalinity source, preferably an aminoalkanol, such as, monoethanolamine, a betaaminoalkanol compound, triethanolamine or mixtures thereof, although any other basic material not otherwise adversely affecting the system can be employed.

Monoethanolamine, beta-aminoalkanol, and triethanolamine compounds serve primarily as solvents when the system pH is above about 10, and especially above about 10.7. They also provide alkaline buffering capacity during use. Other similar materials that are solvents do not provide the same benefit and the effect can be different depending upon the other materials present. When perfumes that have a high percentage of terpenes are incorporated into the inventive car wash compositions, the benefit is greater for the beta-alkanolamines, and they are often preferred, whereas the monoethanolamine is usually preferred.

The alkalinity source, preferably the monoethanolamine and/or beta-alkanolamine, is used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions, the alkalinity source is typically present at a level of from about 0.5% to about 10%, preferably from about 1% to about 5%.

Preferred beta-aminoalkanols have a primary hydroxy group. Suitable beta-aminoalkanols have the formula:

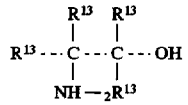

wherein each $R^{13}$ is selected from the group consisting of hydrogen and alkyl groups containing from one to four carbon atoms, and the total number of carbon atoms in the compound is from about 3 to 10, preferably from about 3 to 6, more preferably four. The amine group is preferably not attached to a primary carbon atom. More preferably the amine group is attached to a tertiary carbon atom to minimize the reactivity of the amine group. Specific preferred beta-aminoalkanols are 2-amino-1-butanol; 2-amino-2-methylpropanol; and mixtures thereof. The most preferred beta-aminoalkanol is 2-amino-2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. to 165° C.

Such beta-aminoalkanols are excellent materials for hard surface cleaning in general and, in the present application, have certain desirable characteristics.

The inventive car wash compositions can contain, either alone or in addition to the preferred alkanolamines, more conventional alkaline buffers such as ammonia, other $C_{2-4}$ alkanolamines, alkali metal hydroxides, silicates, borates, carbonates and/or bicarbonates. Moreover, the total amount of alkalinity source is typically from 0 to about 0.5%, to give a pH in the product, at least initially, in use, of from about 7 to about 12, preferably from about 9.5 to about 11.5, more preferably from about 9.5 to about 11.3.

Optional Ingredients

The inventive car wash compositions are intended to be used in combination with water in any desired concentration as further discussed below. Accordingly, water is an optional ingredient which may be omitted from the inventive car wash compositions if desired, as for example to facilitate shipping. In practical terms, water will almost always be present when these compositions are used.

In addition to water, the inventive car wash compositions can contain various other components which are known in the art for aiding or enhancing detergent compositions. For example, the inventive car wash compositions can contain viscosity control agents such as sodium or potassium toluene sulfonate, sodium or potassium cumene sulfonate and sodium or potassium xylene sulfonate.

In addition, the inventive car wash compositions can contain ingredients such as chelates (detergent builders) for neutralizing heavy minerals such as $Ca^{++}$ and $Mg^{++}$ contained in the water with which the inventive car wash compositions will be mixed. Examples of such ingredients are salts of ethylenediaminetetraacetic acid (hereinafter "EDTA"), citric acid, nitrilotriacetic acid (hereinafter "NTA"), sodium carboxymethylsuccinic acid, sodium N-(2-hydroxypropyl)-iminodiacetic acid, and Ndiethyleneglycol-N,N-diacetic acid (hereinafter DIDA). These salts are preferably compatible with the other ingredients in the system and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), and a most preferred builder is EDTA (e.g. sodium).

These additional optional detergent builders, when present, are typically at levels of from about 0.05% to about 0.5%, more preferably from about 0.05% to about 0.3%, most preferably from about 0.1% to about 0.25%.

In addition, the inventive car wash compositions can contain conventional antifoaming or foam control agents such as non-aqueous polar solvents. Specific examples are methanol, ethanol, isopropanol, ethylene glycol, glycol ethers having a hydrogen bonding parameter of greater than 7.7, propylene glycol, and mixtures thereof, preferably isopropanol. The level of non-aqueous polar solvent is usually greater when more concentrated formulas are prepared. Typically, the level of nonaqueous polar solvent is form about 0.5% to about 40%, preferably from about 1% to about 10%, more preferably from about 2%to about 8%.

Optionally, thickeners including for example acryllic copolymers are added; a suitable thickenr is commercially available as Salcare SC90, from Allied Colloids, Suffolk Va.

Also, the inventive car wash compositions can contain conventional biocides, colorants and perfumes, as desired.

Concentrations and Proportions

As in the case of traditional car washes, the inventive car wash compositions are intended to be mixed with water when in a use mode i.e. when actually used for washing operations. Water can be supplied to the inventive car wash compositions when they are first formulated or at a later time. Water can even be supplied after the inventive car wash composition has already been applied to the surface to be washed. Most preferably, the inventive car wash compositions are formulated with some water and supplied either in highly concentrated form for dilution by the customer or in less concentrated for direct application to surfaces to be washed by spray bottle or the like.

The amount or concentration of water in the inventive car wash compositions when in a use mode is not critical and any desirable concentration can be used. As in the case of traditional car washes, the amount of water present should not be so great that the composition becomes ineffective in terms of its cleaning ability. In addition, the amount of water present should not be so little that the inventive compositions become too expensive too use. Also, when the inventive car wash compositions are supplied in concentrated form for later dilution by the customer, it is desirable that they contain from 0 to 90 wt. %, preferably from about 1 to 90 wt. %, more preferably from about 20 to 85 wt. %, most preferably from about 40 to 80 wt. % water. When supplied in a less concentrated form for direct application, it is desirable that the inventive compositions contain from 0 to 95%, preferably from about 1 to 90%, more preferably from about 60 to 90, most preferably from about 75 to 90, wt. % water.

As for the relative portions of the ingredients in the inventive car wash compositions, it is desirable to keep the relative amounts of these ingredients within the proportions as described below.

The amount of substantive polymer in the composition on a weight basis should be about 0.01 to 5.0, more preferably 0.2 to 2 even more preferably 0.7 to 1.5, wt. % based on the weight of the combined surfactant packagesubstantive polymer weight. Compositions containing less substantive polymer than this are typically unable to promote sheeting of rinse water left on the washed car surfaces. On the other hand, if the amount of substantive polymer in the composition is too high, then a noticeable film or streaking occurs after rinsing and drying.

The amount of surfactant package in the composition on a weight basis is from about 1 to 99.1, preferably from about 5 to 70, more preferably from about 10 to 50, most preferably from about 15 to 40 wt. % based on the total weight of the composition.

Within the surfactant package, the amount of first surfactant, i.e. anionic detergent surfactant plus nonionic detergent surfactant, should be 10 to 90, preferably 40 to 85, more preferably 60 to 80 wt. %, based on the weight of the entire surfactant package, i.e. the combined weights of the anionic surfactant, non-ionic surfactant, fluoro-surfactant, and silicone surfactants. If the amount of first surfactant is less than this amount, sheeting of the rinse water is inadequate, leading to formation of water spots on drying. If the amount of first surfactant exceeds this amount, then the washed car surface is either difficult to rinse adequately or a soapy film (streaking or "filming") may form upon drying. Within the surfactant package, the amount of second surfactant, i.e. the fluorosurfactant and/or the silicone surfactant, is from about 10 to 90, preferably 15 to 60, more preferably 20 to 40, wt. % based on the total weight of the surfactant package.

Within the first surfactant, the anionic detergent surfactant is present from 0 to 100 wt. %, preferably about 1 to 100 wt. %, more preferably about 30 to 95 wt. %, most preferably about 60 to 90 wt. %, and the nonionic detergent surfactant is present from 0 to 100 wt. %, preferably about 1 to 100 wt. %, more preferably about 5 to 60 wt. %, most preferably about 10 to 40 wt. % of the total first surfactant weight.

The first surfactant package used in particular applications of the inventive car wash compositions can be composed completely of anionic surfactant or completely of non-ionic surfactant. Preferably, however, the first surfactant package is composed of a mixture of anionic and non-ionic surfactants, with the amount of non-ionic surfactant being less than the amount of anionic surfactant. Although compositions made with no nonionic surfactant are acceptable, the addition of nonionic surfactant to such compositions results in a noticeable improvement in terms of sheeting action. Similarly, compositions made with no anionic surfactant, although effective, may be difficult to rinse off the car surfaces adequately. Inclusion of anionic surfactant in such compositions noticeably improves rinseability, thereby improving performance.

Within the second surfactant, the fluoro-surfactant is present from 0 to 100%, and when present, it is preferred that the fluoro-surfactant be present from about 1 to 100%, more preferably from about 4 to 15%, most preferably about 7 to 8%. The silicone surfactant is present is from 0 to 100%, preferably from about 1 to 100%, more preferably from about 85 to 96%, most preferably from about 92 to about 93%. If the amount of second surfactant exceeds this amount, then film streaking may occur, while if the amount is less than this amount, the sheeting of the rinse water may be insufficient.

As can be appreciated by those skilled in the art, the relative amount of each ingredient to be included in a particular example of the inventive car wash composition varies depending on the specific surfactants and polymers employed as well as the types and amounts of processing aids and other ingredients incorporated in the system. For example, when sodium DDBSA (sodium dodecylbenzenesulfonate) is the anionic surfactant, it should be present in the inventive compositions in an amount of approximately 60 to 75 wt. %, based on the combined weight of the surfactant package, when the substantive polymer is VP/AA. However, when the anionic surfactant is DOS (dioctylsulfosuinate or ethersulfate), it should be present in the amount of approximately 40 to 60 wt. %. Those skilled in the art can readily determine the optimal amounts of each ingredient to include in specific embodiments of the inventive compositions by routine experimentation.

Surfaces to be Washed

The inventive compositions can be used to clean essentially any surface typically found in modern automobiles and other wheeled vehicles. Examples are the painted or unpainted surfaces of various components such as plastic or metal body panels, plastic or metal bumpers and the like, glass, rubber components such as tires, bumpers and so forth, soft vinyl surfaces such as convertible tops, tonneaus, interior vinyl and leather components such as dash boards, seating and so forth. In addition, the inventive car wash compositions can be used for cleaning other types of vehicles such as boats, jet skis, vans, trailers, motor homes, etc., or any other article having relatively non-porous surfaces. However, the inventive compositions sheet out on painted surfaces rather than glass, plastic, rubber or vinyl surfaces.

Technicues of Application

The inventive car wash composition can be applied to the surfaces to be cleaned in essentially any manner. Most conveniently, it is applied by spray bottle, sponge or other applicator. Thereafter, the surfaces to be cleaned are washed by light rubbing or otherwise working the composition into the surface to be cleaned in an otherwise conventional manner. Once this washing step is completed, the inventive car wash composition plus any dirt that may be entrained therein is removed, preferably by rinsing with water.

In accordance with the present invention, it has been found that water remaining on the washed surface after rinsing spreads out into the form of a relatively thin sheet rather than forming discrete droplets of water as in the case of prior art car washes. Much of this water film or sheet slides off the washed surfaces by the action of gravity without forming rivulets, streaking or tracking. In other words, the water slides off as a sheet rather than discrete droplets or rivulets conglomerated along a particular path on the washed surface. Rinse water which does not slide off remains on the washed surfaces still in the form of a thin sheet or film. When this sheet or film evaporates, water spots do not form.

Although not wishing to be bound to any theory, it is believed that the effect occurring in the present invention is similar to that occurring upon the evaporation of the glass-treating compositions described in International Application no. PTC/US95/09273, the disclosure of which is incorporated herein by reference. In particular, it is believed that the substantive polymer of the inventive compositions bonds to the washed surface in such a manner that pendant hydrophilic groups, e.g. carboxylate groups, project therefrom. In the aggregate, these pendant hydrophilic groups cause the washed surface to become more hydrophilic in nature. This in turn reduces the surface tension of the washed surface, thereby allowing rinse water to form up as a thin, continuous or semi-continuous layer rather than discreet droplets. When water in this form evaporates, the minerals therein are not concentrated enough in terms of location to be visible. Accordingly, no spots are formed.

In any event, it has been found in accordance with the present invention that the combination of the substantive polymer described above with a surfactant package containing all four of the foregoing ingredients, i.e. the anionic surfactant, the nonionic surfactant and the silicone surfactant, and the alkalinity source, is necessary to achieve the desired sheeting action. If any one of these ingredients is omitted, the composition will not sheet in the desirable fashion.

Formulating Techniques

The inventive car wash compositions can be formulated in any convenient manner. However, it is desirable to formulate these compositions by a procedure in which the substantive polymer is first dissolved in water and then each of the anionic surfactant, the nonionic surfactant and the silicone surfactant, in that order, are separately added to, and dissolved in, the composition before the next component is added. Thereafter, the detergent builder and the other desired processing aids can be added.

In this connection, it is desirable in accordance with the present invention to form the inventive car wash compositions in the form of clear liquids. In order to do this, it is preferable that the substantive polymer be dissolved in water. Obviously, this means the water needs to be included in these compositions. In addition, this also means that the formulation procedure used should be one which facilitates complete dilution of each ingredient.

In this regard, some of the substantive polymer described above will dissolve in neutral water. Others require an alkaline pH. Therefore, it may be necessary to add a suitable alkaline material, as described above, to the water used for dissolving the polymer prior to the addition of the other ingredients. For this purpose, any conventional alkaline material, as described above, which does not otherwise adversely affect the system can be used for adjusting the pH to an alkaline value. Preferably, however, monoethanolamine and/or a betaaminoalkanol compound is used for this purpose. These alkaline materials also improve the properties of the inventive car wash compositions in terms of enhanced rinse water sheeting compared with conventional alkaline materials. Accordingly, it is preferable that one of these materials be used as the alkaline source as this provides a superior product.

Working Examples

In order to more thoroughly describe the present invention, the following working examples are presented.

Example 1

A car wash composition in accordance with the present invention and having the following composition was prepared:

TABLE I

| Ingredient | Weight % of total |
|---|---|
| Water | balance |
| poly (vinylpyrrolidine/acrylic acid)[1] | 0.4 |
| monoethanolamine | 3.0 |
| sodiumdodecylbenzenesulfonate[2] | 20.0 |
| Condensate of 12 mols ethylene oxide and nonylphenol[3] | 3.0 |
| polysiloxane/polyethylene glycol copolymer[4] | 10.0 |
| EDTA (ethylenediaminetetracetic acid)[5] | 0.2 |
| Preservative | 0.2 |
| dye | 0.1 |

[1]25% VP/75% AA - Polymer ACP 1005 from ISP
[2]Witconate 1240 Slurry from Witco, Inc, 40% active solution.
[3]Witonate NP120 from Witco, Inc.
[4]Walker Silicone Fluid L066 from Walker Chemie CmbH, Burghausen, Germany
[5]Versene 100 from Dow Chemical Corporation In formulating this composition, the monoethanolamine was first added to the water to achieve an alkaline pH and then the substantive polymer, the poly(vinylpyrrolidone/acrylic acid) polymer was mixed therein until dissolved. Next, the three surfactants were added in the order appearing in Table 1, in series, each being dissolved in the system before the next was added. Finally, the EDTA, the preservative and dye were added.

Example 2

A car wash composition in accordance with the present invention and having the following composition was prepared as in Example 1:

| Ingredient | Weight % |
|---|---|
| Water | balance |
| poly(vinylpyrrolidine/acrylic acid)[1] | 0.4 |
| triethanolamine | 3.0 |
| sodiumdodecylbenzenesulfonate[2] | 20.0 |
| Condensate of 12 mols ethylene oxide and nonylphenol[3] | 3.0 |
| polysiloxane/polyethylene glycol/copolymer[4] | 10.0 |
| EDTA (ethylenediaminetetracetic acid)[5] | 0.2 |
| Preservative | 0.2 |
| dye | 0.1 |

[1–5]For commercial designations and source, see Example 1

Example 3

An all car wash composition having a nonionic surfactant and lacking an anionic surfactant, in accordance with the present invention and having the following composition was prepared as in Example 1:

| Ingredient | Weight % |
|---|---|
| poly (vinylpyrrolidine/acrylic acid)[1] | 0.4 |
| monoethanolamine | 3.0 |
| Condensate of 12 mols ethylene oxide and nonylphenol[3] | 86.4 |
| polysiloxane/polyethylene glycol/copolymer[4] | 10.0 |
| EDTA (ethylenediaminetetracetic acid)[5] | 0.2 |
| Preservative | 0.2 |
| dye | 0.1 |

[1–5]For commercial designations and source, see Example 1.

Example 3 did not contain any appreciable amount of water.

Example 4

A car wash composition in accordance with the present invention and having the following composition was prepared as in Example 1:

| Ingredient | Weight % |
|---|---|
| Water | balance |
| poly (vinylpyrrolidine/acrylic acid)[1] | 0.4 |
| monoethanolamine | 3.0 |
| sodiumdodecylbenzenesulfonate[2] | 20.0 |
| Condensate of 12 mols ethylene oxide and nonylphenol[3] | 0 |
| polysiloxane/polyethylene glycol/copolymer[4] | 10.0 |
| EDTA (ethylenediaminetetracetic acid)[5] | 0.2 |
| Preservative | 0.2 |
| dye | 0.1 |

[1–5]For commercial designations and source, see Example 1

The compositions so obtained from Examples 1–4 were then used to clean the dirty surface of an automobile. Each composition was charged into a bucket and mixed with water such that the concentration of water in the composition was about 97% by weight. The car was then washed by first rinsing the car to remove any loose dirt, dipping a sponge into the wash bucket and wiping the car with the wetted sponge. Then the soapy solution was rinsed off the car with water from a garden hose. The car was then given a final light rinse.

After rinsing was completed, it was observed for all examples that much of the rinse water slid off the washed surface by the action of gravity. In this process, the water came off essentially in the form of sheets, not in the form of rivulets. In addition, it was also observed that the water remaining on the rinsed surfaces, which was present primarily on the flat horizontal surfaces of the automobile, was present in the form of a film, rather than discreet droplets.

This film was allowed to dry in the air by normal evaporation, without wiping with a cloth or chamois. When the washed surfaces were completely dry it was found that no visible water spots were produced.

Example 5

A car wash composition in accordance with the present invention and having the following composition was prepared as in Example 1:

| Ingredient | Amount wt. % |
|---|---|
| isopropyl alcohol | 3 |
| sodium xylene sulfonate | 3 |
| Water | balance |
| poly(vinylpyrrolidine/acrylic acid) | 0.2 |
| monoethanolamine | 3.0 |
| sodiumdodecylbenzenesulfonate | 5.0 |
| Condensate of 12 mols ethylene oxide and nonylphenol | 0.5 |
| polysiloxane polyethylene glycol/copolymer | 1.0 |
| EDTA | 0.2 |
| dye | 0.1 |
| preservative | 0.2 |

sodium xylene sulfonate, 40% solution, from Witcol Inc.
isopropyl alcohol, 91% solution, from Shell Chemical Company
For other commercial designations and source, see Example 1

Example 6

A composition was prepared as in example 1, except that fluorosurfactant Zonyl® from Dupont Specialty Chemicals, was used instead of the polysiloxane/polyethylene glycol copolymer silicone surfactant.

The compositions so obtained were used to clean a car as in Examples 1through 4. The automobile was washed and rinsed in the general manner described above using a sponge to wipe the inventive car wash composition onto all of the surfaces.

As in the case of the other examples, it was found that the inventive car wash composition of Example 5 cleaned the automobile surfaces very well. In addition, the water remaining on the car surfaces, after rinsing, sheeted out into thin film form. Moreover, the rinsed surfaces, when dried without wiping, were free of water spots.

Although a few embodiments of the present invention have been described above, it should be appreciated that many modifications can be made without departing from the spirit and scope of the invention. All such modifications are intended to be included within the scope of the present invention, which is to be eliminated only by the following claims.

What is claimed is:

1. A car wash composition for cleaning a surface to be washed, said.composition comprising:

a. from about 1 to about 99.99 weight % of the composition weight, of a surfactant package, containing:

from about 10 to about 85 weight % of the surfactant package, of a first surfactant selected from the group consisting of: anionic surfactant, a non-ionic surfactant or mixtures thereof; and from about 15 to 90 weight % of the surfactant package, of a a silicone surfactant selected from the group consisting of: a polysiloxane polyethylene glycol copolymer; and condensation products of alkyl-substituted siloxanes copolmerized with condensation products of alkylene oxide; and mixtures thereof;

b. from 0.01 to 5 weight % of the surfactant package weight of a substantive polymer, capable of bonding with said surface to thereby provide said surface with enhanced hydophillicity, having a molecular weight of from about 100,000 to 2,000,000, wherein said substantive one polymer contains carboxylate functionality, and contains at least one polymerized monomer selected from the group consisting of: acrylic acid; maleic acid; ethylene; vinyl pyrrolidone; methacrylic acid; methacryloylethylbetaine; and mixtures thereof;

c. from 0 to about 95% water.

2. A car wash composition of claim 1 further comprising:

an alkalinity source, to provide the composition with a pH of from about 7 to 12.

3. The composition of claim 1, wherein said substantive polymer is a copolymer of acrylic acid and vinyl pyrrolidone containing about 5 to 50 mole % vinyl pyrrolidone.

4. The composition of claim 1, wherein said anionic surfactant is a salt of a sulfate, sulfonate, carboxylate or amide.

5. The composition of claim 4, wherein said anionic surfactant is selected from the group consisting of:

(a) an alkali metal, ammonium or alkanolammonium salt of a higher fatty acid containing from about 8 to 24 carbon atoms;

(b) a water-soluble salt of an organic sulfuric reaction product having in its structure an alkyl group containing about 8 to 22 carbon atoms;

(c) an alkali metal paraffin sulfonate containing about 8 to 22 carbon atoms in its paraffin chain;

(d) an alkyl or alkenyl ether sulfate in which the alkyl or alkenyl group has about 8 to 22 carbon atoms;

(e) an alkali metal salt of an alkyl phenol ethylene oxide ether sulfate having about 4 units of ethylene oxide per molecule and in which the alkyl radical contains about 9 carbon atoms;

(f) the reaction product of a fatty acid esterified with isethionic acid and neutralized with sodium hydroxide;

(g) a sodium or potassium salt of a fatty acid amide of a methyl taurine; and mixtures thereof.

6. The composition of claim 5, wherein said anionic surfactant is (a) a $C_8$ to $C_{18}$ alkyl benzene sulfonate, or (b) a $C_{12}$ to $C_{18}$ alkyl sulfate, or (c) a $C_{12}$ to $C_{18}$ ethoxylated alkyl sulfate having from 1 to 10 ethoxy moieties, or (d) a sodium paraffin sulfonate wherein the alkyl portion thereof contains from 8 to 16 carbon atoms.

7. The composition of claim 6, wherein said anionic surfactant is a sodium or potassium linear alkyl benzene sulfonate having 11 to 12 carbon atoms in its alkyl chain.

8. The composition of claim 1, wherein said non-ionic surfactant nonionic is an alkylene oxide condensate, an amide or a semi-polar compound exhibiting surface active properties.

9. The composition of claim 8, wherein said non-ionic surfactant is a semi-polar compound.

10. The composition of claim 8, wherein said nonionic surfactant is an amide.

11. The composition of claim 8, wherein said nonionic surfactant is an alkylene oxide condensate.

12. The composition of claim 11, wherein said nonionic surfactant is a condensate of ethylene oxide and an alkyl phenol having about 6 to 12 carbon atoms in its alkyl chain.

13. The composition of claim 1, wherein said polysiloxane polyethylene glycol copolymer, when present in water at a concentration of 1 weight %, has a surface tension at 25° C. of 20 to 330 mN/m, and, further wherein said polysiloxane polyethylene glycol copolymer has a viscosity at 25° C. of about 20 to 4000 cSt $mm^2/s$.

14. The composition of claim 1, wherein said composition has a pH of 7 to 12, wherein said anionic surfactant is a salt of a sulfate, sulfonate, carboxylate or amide, present from 30 to 95 wt. % of the first surfactant; and wherein said non-ionic surfactant is an alkylene oxide condensate, an amide or a semi-polar compound exhibiting surface active properties, present from 5 to 60 wt. % of the first surfactant.

15. The composition of claim 14, wherein said anionic surfactant is (a) a $C_8$ to $C_{16}$ alkyl benzene sulfonate, or (b) a $C_{12}$ to $C_{18}$ alkyl sulfate, or (c) a C12 to C18 ethoxylated alkyl sulfate having from 1 to 10 ethoxy moieties, or (d) a sodium paraffin sulfonate wherein the alkyl portion thereof contains from 8 to 16 carbon atoms, and wherein said non-ionic surfactant is an alkylene oxide condensate.

16. The composition of claim 15, wherein said substantive polymer is a copolymer of acrylic acid and vinyl pyrrolidone containing at least 10 mol % acrylic acid and said copolymer has a molecular weight of 200,000 to 1,000,000, said copolymer is present from about 0.2 to 2 wt. %, wherein said anionic surfactant is a sodium or potassium linear alkyl benzene sulfonate having 11 to 12 carbon atoms in its alkyl chain, wherein said non-ionic surfactant is a condensate of ethylene oxide and an alkyl phenol having about 6 to 12 carbon atoms in its alkyl chain, and wherein said silicone surfactant is a polysiloxane polyethylene glycol copolymer.

17. The composition of claim 16, wherein the alkalinity source comprises an aminoalkanol, and further wherein said composition has a pH of about 10 to 11.5.

18. The composition of claim 1, where in the substantive polymer is present from about 0.2 to 1.5 weight % based on the surfactant package weight, the first surfactant is present from about 40 to 80 weight % of the surfactant package weight, and the second surfactant is present from about 10 to 60 weight % of the surfactant package weight.

19. The composition of claim 1, where in the substantive polymer is present from about 0.5 to 1 weight % based on the surfactant package weight, the first surfactant is present from about 65 to 75 weight % of the surfactant package weight, and the second surfactant is present from about 15 to 25 weight % of the surfactant package weight.

20. The composition of claim 2, wherein the first surfactant comprises sodium dodecylbenzenesulfonate and a condensate of ethylene oxide and an alkyl phenol having about 6 to 12 carbon atoms in its alkyl chain, the second surfactant comprises a polysiloxane-polyethyleneglycol copolymer having a molecular weight of from about 500 to 10,000, the alkalinity source comprises monethanolamine or triethanolamine, the substantive polymer comprises a poly (vinylpyrrolidone/acrylic acid)copolymer having an average molecular weight of about 250,000 and a ratio of vinylpyrrollidone to acrylic acid of about 25:75, and water.

21. The composition of claim 2, wherein the first surfactant comprises a condensate of ethylene oxide and an alkyl phenol having about 6 to 12 carbon atoms in its alkyl chain, the second surfactant comprises a polysiloxane-polyethyleneglycol copolymer, the alkalinity source comprises monethanolamine or triethanolamine, and the substantive polymer comprises a poly(vinylpyrrolidone/acrylic acid)copolymer having an average molecular weight of about 250,000 and a ratio of vinylpyrrollidone to acrylic acid of about 25:75.

22. The method of washing a painted surface of a vehicle comprising the following steps:

a. providing a car wash composition of claim 1;

b. applying the composition to the vehicle; and c. rinsing the composition with water.

23. A car wash composition for cleaning a surface to be washed, said composition comprising:

a. from about 1 to about 99.99 weight % of the composition weight, of a surfactant package, containing:

from about 10 to about 85 weight % of the surfactant package, of a first surfactant selected from the group consisting of: anionic surfactant, a non-ionic surfactant or mixtures thereof; and from about 15 to 90 weight %k of the surfactant package, of a fluoro-surfactant;

b. from 0.01 to 5 weight % of the surfactant package weight of a substantive polymer, capable of bonding with said surface to thereby provide said surface with enhanced hydophillicity, having a molecular weight of from about 10,000 to 3,000,000; wherein said substantive polymer contains carboxylate functionality, and contains at least one polymerized monomer selected from the group consisting of: acrylic acid; maleic acid; ethylene; vinyl pyrrolidone; methacrylic acid; methacryloylethylbetaine; and mixtures thereof;

c. from 0 to about 95% water.

24. The composition of claim 23, further comprising an alkalinity source, to provide the composition with a pH of from about 7 to 12;

said anionic surfactant is a salt of a sulfate, sulfonate, carboxylate or amide, present from 30 to 95 wt. % of the first surfactant; and said non-ionic surfactant is an alkylene oxide condensate, an amide or a semi-polar compound exhibiting surface active properties, present from 5 to 60 wt. % of the first surfactant;

said fluorosurfactant comprising: a fluorinated hydrophobic segment having the following structure:

$$F(CF_2CF_2)_{3-8}$$

and a hydrophilic segment having an alkyl group having from about 2 to 12 carbons and an ester, sulfonate, or carboxylate moiety.

25. The composition of claim 24, wherein said anionic surfactant is (a) a $C_8$ to $C_{16}$ alkyl benzene sulfonate, or (b) a $C_{12}$ to $C_{18}$ alkyl sulfate, or (c) a $C_{12}$ to $C_{18}$ ethoxylated alkyl sulfate having from 1 to 10 ethoxy moieties, or (d) a sodium paraffin sulfonate wherein the alkyl portion thereof contains from 8 to 16 carbon atoms, and said non-ionic aurfactant is an alkylene oxide condensate; and, said fluorosurfactant is ammonium perfluoroalky carboxylate or potassium fluoroalky carboxylate.

26. The composition of claim 23, wherein said substantive polymer is present from about 0.2 to 1.5 weight % based on the surfactant package weight, and is a copolymer of acrylic acid and vinyl pyrrolidone containing at least 10 mol % acrylic acid and said copolymer has a molecular weight of 200,000 to 1,000,000, said copolymer is present from about 0.2 to 2 wt. %, wherein said first surfactant is present from about 40 to 80 weight % of the surfactant package weight, wherein said anionic surfactant is a sodium or potassium linear alkyl benzene sulfonate having 11 to 12 carbon atoms in its alkyl chain, and said non-ionic surfactant is a condensate of ethylene oxide and an alkyl phenol having about 6 to 12 carbon atoms in its alkyl chain; and second surfactant is present from about 10 to 60 weight % of the surfactant package weight.

27. The composition of claim 24, wherein: the substantive polymer is present from about 0.5 to 1 weight % based on the surfactant package weight, the first surfactant is present from about 65 to 75 weight % of the surfactant package weight, and the second surfactant is present from about 15 to 25 weight % of the surfactant package weight, said first surfactant comprises a condensate of ethylene oxide and an alkyl phenol having about 6 to 12 carbon atoms in its alkyl chain, or sodium dodecylbenzenesulfonate and a condensate of ethylene oxide and an alkyl phenol having about 6 to 12 carbon atoms in its alkyl chain;

the alkalinity source comprises monethanolamine or triethanolamine, and the substantive polymer comprises a poly(vinylpyrrolidone/acrylic acid)copolymer having an average molecular weight of about 250,000 and a ratio of vinylpyrrollidone to acrylic acid of about 25:75;

said fluorosurfactant is aqueous mixture of potassium fluoroalkyl carboxylates having from about 40 to 44% of fluoroalkyl carboxylates having 8 carbons in the alkyl chain, or has the chemical structure:

$$F(CF_2CF_2)_{3-8}CH_2CH_2O(CH_2CH_2O)_yH$$

and surface tension in deionized water of 22 dyn/cm at a concentration of 0.001% at 25° C.

28. The method of washing a painted surface of a vehicle comprising the following steps:

a. providing a car wash composition of claim 28;

b. applying the composition to the vehicle; and c. rinsing the composition with water, from the vehicle.

* * * * *

UNITED STATES PATENT AND TRADEMARK OFFICE

CERTIFICATE OF CORRECTION

PATENT NO. : 5,759,980

DATED : June 2, 1998

INVENTOR(S) : Russo, et al.

It is certified that error appears in the above-identified patent and that said Letters Patent is hereby corrected as shown below:

Claim 1, col. 16, line 54, delete "copolmerized" and insert "copolymerized";

Claim 1, col. 16, line 62, omit the word "one" in front of "polymer";

Claim 1, col. 16, line 62, delete "carboxvlate" and insert "carboxylate";

Claim 23, col. 19, line 11, omit "k" after "%".

Signed and Sealed this

Fifth Day of January, 1999

*Attest:*

*Attesting Officer*

*Acting Commissioner of Patents and Trademarks*